US005455748A

United States Patent [19]

Cotten et al.

[11] Patent Number: 5,455,748

[45] Date of Patent: Oct. 3, 1995

[54] LIGHTING CONTROL CONSOLE

[75] Inventors: Lary R. Cotten; Mark A. Stultz, both of Austin, Tex.

[73] Assignee: High End Systems, Inc., Austin, Tex.

[21] Appl. No.: 255,926

[22] Filed: Jun. 7, 1994

[51] Int. Cl.[6] ..... F21P 5/00

[52] U.S. Cl. ..... 362/85; 362/154; 206/320; 190/1; 190/106; 190/115

[58] Field of Search ..... 362/85, 98, 154, 362/156; 206/320, 334, 315.11; 220/335, 212.15, 555; 200/5 A, 5 R; 190/1, 900, 106, 109, 115; 312/237

[56] References Cited

U.S. PATENT DOCUMENTS

| | | | |
|---|---|---|---|
| 1,571,475 | 2/1926 | Guenther | 190/900 |
| 3,045,900 | 7/1962 | Zekendorf | 150/106 |
| 4,050,493 | 9/1977 | Cho | 150/106 |
| 4,522,288 | 6/1986 | Wickman et al. | 190/900 |
| 4,589,546 | 5/1986 | Sunderland | 220/212.5 |
| 4,700,634 | 10/1987 | Mills et al. | 362/98 |
| 4,796,735 | 1/1989 | Horiuchi | 190/900 |
| 4,960,233 | 10/1990 | Morchower | 150/106 |
| 5,010,459 | 4/1991 | Taylor et al. | 362/85 |
| 5,115,893 | 5/1992 | Terkildsen | 190/900 |

OTHER PUBLICATIONS

Lighting Dimensions, Apr. 1993, Pulsar Light advertisement, p. 38.

Lighting Dimensions, Apr. 1973, Electronics Diversified advertisement, p. 73.

Lighting Dimensions, Apr. 1993, Leprecon advertisement, p. 76.

WDR, vol. 4 Issue 5 1994, Laser Systems advertisement, p. 107.

*Primary Examiner*—Ira S. Lazarus
*Assistant Examiner*—L. Heyman
*Attorney, Agent, or Firm*—James R. Bell

[57] ABSTRACT

A lighting control console has a base and a top. The top includes a control panel having control members on one side operably connected to control circuits on an opposite side. The circuits are covered by a removable insulation member. The top is connected to the base and is movable relative to the base between a closed position and an open position. In the closed position, the top and base are in nested contact. In the open position, the top is raised relative to the base. A storage compartment is provided in the base. The storage compartment and circuits can be accessed when the top is in the open position. When the top is in the closed position, the insulation member insulates the circuits from the storage compartment. A handle is provided on the console and is suitable for hand gripping so that the control console can be carried.

9 Claims, 3 Drawing Sheets

LIGHTING CONTROL CONSOLE

FIELD OF THE INVENTION

This invention relates generally to control of theater and stage lighting and the like and more particularly to a console used as a control panel for such lighting.

BACKGROUND OF THE INVENTION

Lighting control consoles are used in the entertainment lighting industry for controlling lighting functions such as light intensity, color, position and movement. More recently, these functions have become preprogrammed through the use of a computer in connection with the console. In this manner, an entire performance and each component of the performance can be preprogrammed so that the desired lighting effects occur on cue.

There is a need for a full size controller with immediate or real time function control, having easy to access hardware, and being capable of providing more control of lighting fixtures, controlling a greater number of fixtures, controlling groups of various fixtures, interfacing with a microprocessor, providing the access and speed of programming, providing a storage feature, and which is ergonomically engineered and portable.

The foregoing illustrates limitations of the known prior art. Thus it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing a lighting control console having a base, a top including a control panel, the top being connected to the base and being movable relative to the base between a closed position, wherein the top and base are in nested contact, and an open position, wherein the top is raised relative to the base, and a storage compartment in the base, whereby when the top is in the open position, the storage compartment can be accessed.

In another aspect of the invention, this is accomplished by providing a lighting console having a base, a top including a control panel, the top being movably connected to the base and movable between a closed position, wherein the top and base are in nested contact, and an open position, wherein the top is raised relative to the base, the control panel including a plurality of movable control members mounted for hands-on operation on a first side of the top, the top including control circuits connected for control changes responsive to operation of the control members, the circuits being mounted on a second side of the top, opposite the first side, whereby the circuits can be accessed for maintenance when the top is in the open position, means interconnecting the base and top for maintaining the top in the open position, a storage compartment in the base, whereby when the top is in the open position, the storage compartment can be accessed, and a handle on the console suitable for hand gripping, whereby the console can be hand carried.

In yet another aspect of the invention, this is accomplished by providing a lighting control console having a base, a top including a control panel, the top being movably connected to the base and movable between a closed position, wherein the top and base are in nested contact, and an open position, wherein the top is raised relative to the base, the control panel including a plurality of movable control members mounted for hands-on operation on a first side of the top, the top including control circuits connected for control changes responsive to operation of the control members, the circuits being mounted on a second side of the top, opposite the first side, whereby the circuits can be accessed for maintenance when the top is in the open position, means interconnecting the base and top for maintaining the top in the open position, a storage compartment in the base, whereby when the top is in the open position, the storage compartment can be accessed, an insulator member mounted on the second side of the top covering the circuits, whereby when the top is in the closed position, the modules are insulated from the storage compartment, and a handle on the console suitable for hand gripping, whereby the console can be hand carried.

The foregoing and other aspects will become apparent from the following detailed description of the invention when considered in conjunction with the accompanying drawing figures. It is to be expressly understood, however, that the figures are not intended as a definition of the invention, but are for the purpose of illustration only.

BRIEF DESCRIPTION OF THE DRAWING FIGURES

DETAILED DESCRIPTION OF THE INVENTION

Figures 1, 3:
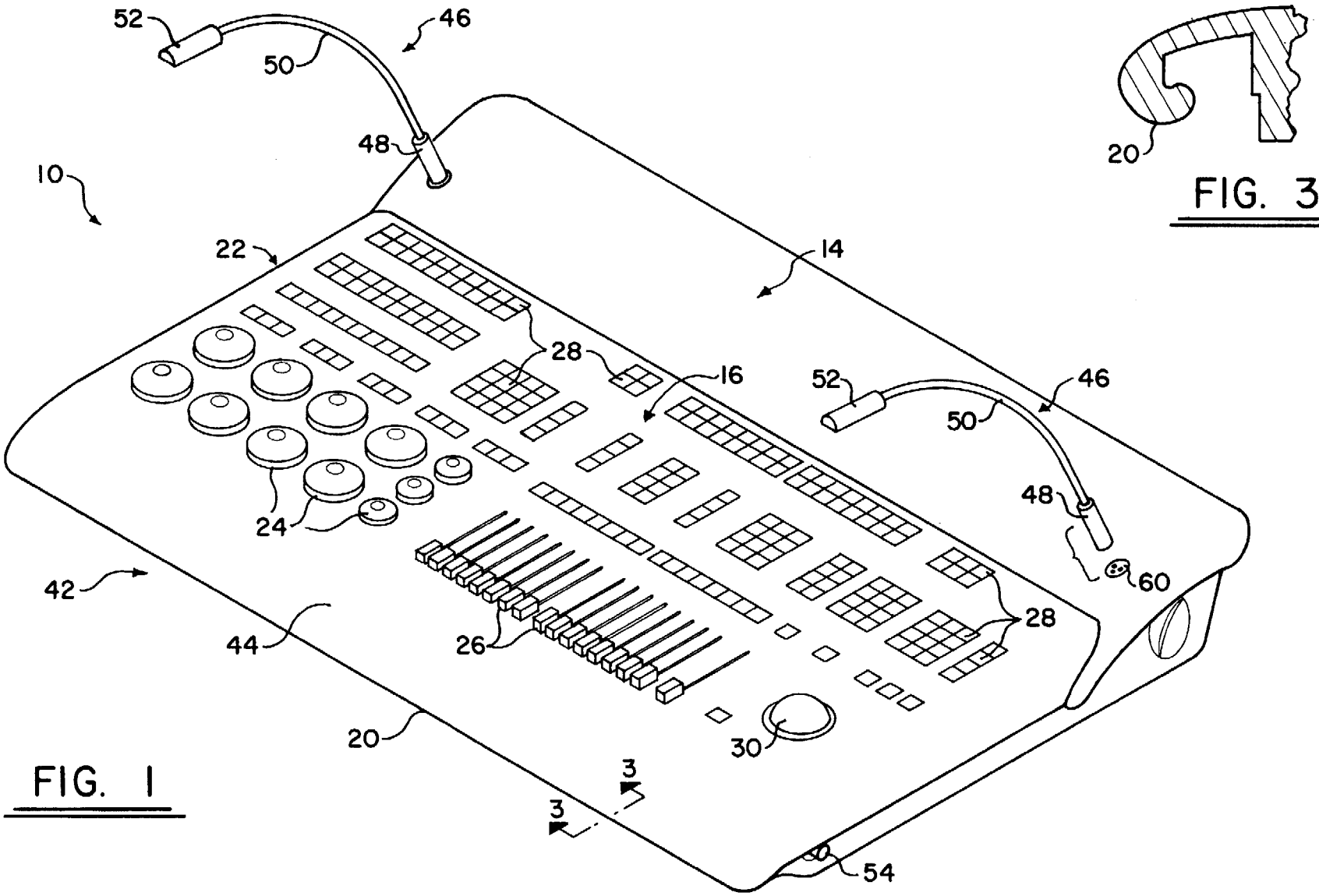
FIG. 1 is a perspective view illustrating an embodiment of the control console of the present invention with the top in the closed position.
FIG. 3 is a partial sectional view taken along the lines of 3—3 of FIG. 1 illustrating an embodiment of the handle formed in the top.

The lighting control console of the present invention is generally designated 10 in FIG. 1. Console 10 includes a base 12 and a top 14 which includes a control panel 16. Top 14 is connected to base 12 by conventional means for pivotal movement so that top 14 can move between a closed position, in FIG. 1, wherein top 14 is in nested closure with base 12, and an open position, in FIG. 2, wherein top 14 is raised relative to base 12.

Within console 10, and seated in base 12, is a pre-formed, compartmentalized storage tray 18 which is accessible when the top 14 is in the open position. The storage tray 18 is used for storing articles associated with use of the console, to be discussed later in greater detail. Console 10 also includes means such as a handle 20, FIG. 3, which is suitable for hand gripping. In this manner, console 10 can be hand carried, while in the closed position.

The control panel 16, FIG. 1, includes an array of movable control members mounted for hands-on operation on a first side 22 of top 14. These movable control members include a plurality of bi-directional rotatable control members 24, a plurality of hi-directional slidable control members or faders 26, a plurality of push-button control members 28 and a track ball control member 30.

Figure 2:
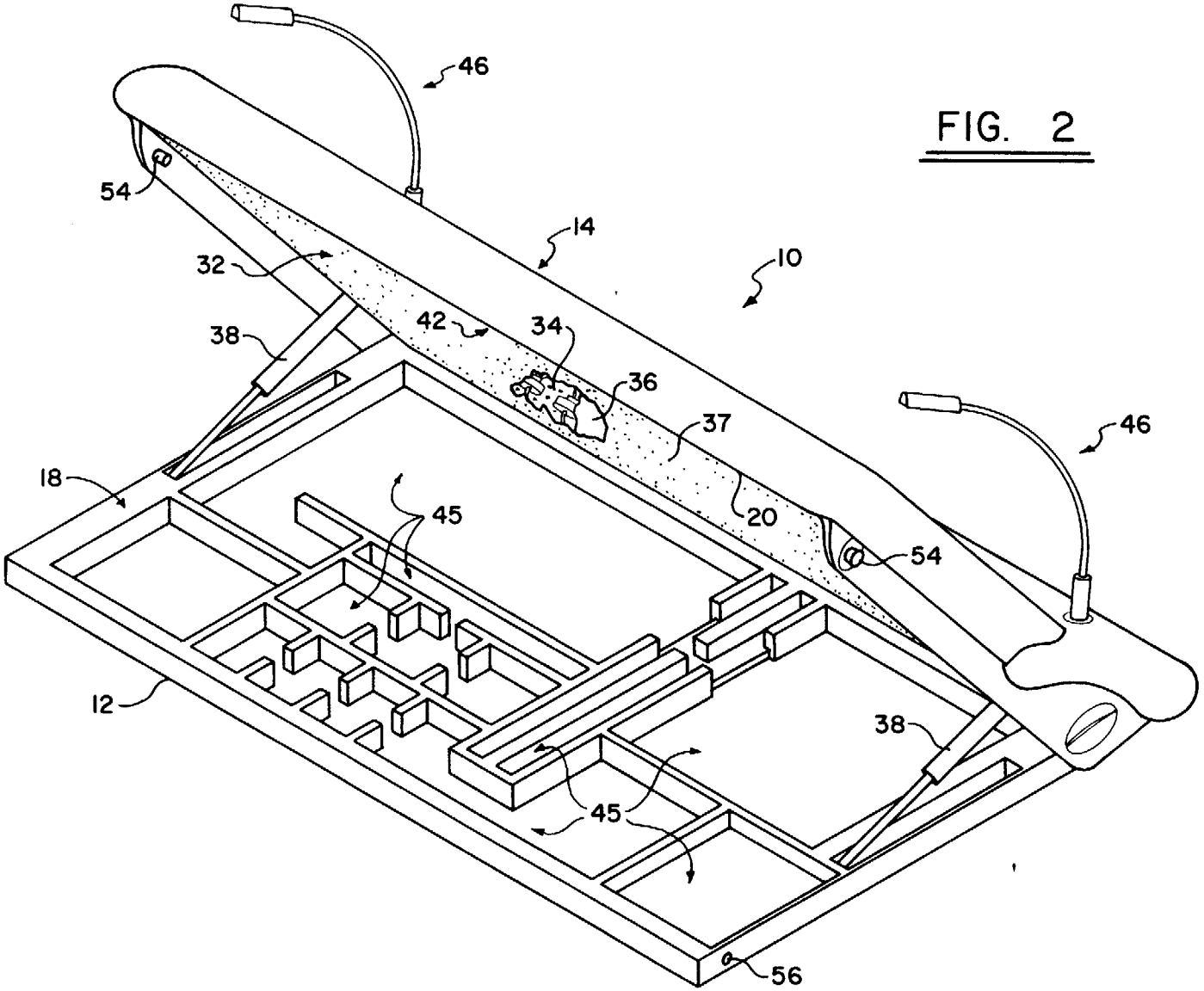
FIG. 2 is a perspective view illustrating an embodiment of the control console of the present invention with the top in the open position.

A second side 32 of top 14, FIG. 2, includes control circuits 34 mounted thereon and connected for control changes responsive to operation of control members 24, 26, 28, 30 as is well known. The circuits 34 are easily accessible for maintenance when the top 14 is in the open position. An insulator cover 36 is preferably formed of rigid foam board and is provided to protect and insulate the circuits 34. Cover 36 is removably mounted in top 14 by means of a plurality of threaded standoffs (not shown).

Assisting in the closing, opening and maintaining top 14 in the open position, are a pair of gas shocks 38 positioned at opposite ends of console 10 so as to interconnect base 12 and top 14.

Base 12 and top 14 are generally rectangularly shaped and each include four edges. A feature of top 14 is the provision on one of the four edges of the elongated handle 20, which extends substantially along the entire length of the one edge designated 42, see FIGS. 2 and 3. Handle 20 is provided to be hand gripped when the top 14 and base 12 are in the closed position to provide for portability by hand carrying console 10. While handle 20 is provided on second side 32 of top 14, a convenient wrist pad 44, FIG. 1, is immediately adjacent handle 20 on first side 22.

A pair of lights 46 are detachably connected to first side 22 of top 14. Lights 46 have a keyed detachable base 48, a flexible neck 50 and a light element housing 52. Lights 46 are easily positionable to illuminate control panel 16 as desired by an operator.

A pair of spring loaded retainer members 54 are carried by top 14 and are positioned to be aligned with apertures 56 formed in base 12 so that when top 14 and base 12 are in their nested, closed position, the spring loaded members 54 are resiliently urged to extend into apertures 56, thus retaining top 14 and base 12 in the closed position.

Base 12 is generally formed as a rectangular steel tray and includes storage tray 18 which is vacuum formed of a suitable synthetic material to include various sized compartments 45 for storing lights 46 when console 10 is transported. The compartments can also store peripheral equipment, such as computer components used in association with console 10, and even tools which are used or may be used by the operator. Cover 36 also includes a resilient pad 37 formed of a compressible foam-like material such as convoluted polyester. Pad 37 is compressed between top 14 and base 12 when in the closed position. This permits pad 37 to engage items stored in compartments 45 of storage tray 18 so that those items are restrained from movement in the compartments when the closed console 10 is transported.

Control panel 16 is preferably an aluminum sheet, whereas top 14 is formed of a combination of injection molded pieces and extruded pieces of a suitable synthetic material. Control members 24, 26, 28, 30 are commercially available parts as are gas shocks 38 and spring loaded retainer members 54.

Figure 4:
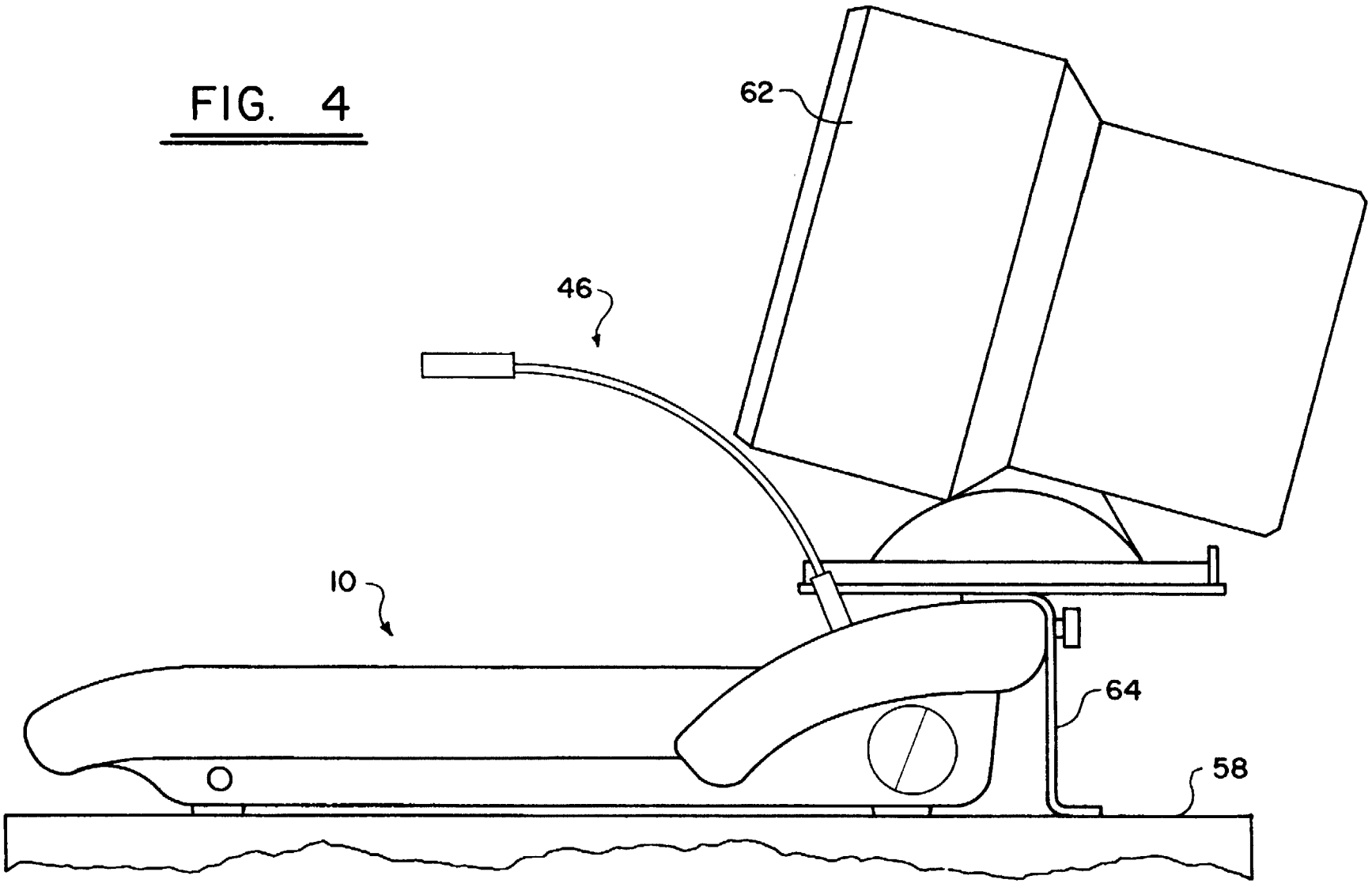
FIG. 4 is a side view illustrating an embodiment of the control console of this invention used with an associated monitor.

When console 10 is to be used, it is positioned on a flat support surface 58, FIG. 4. Retainer members 54 are manually urged against their spring load to withdraw them from apertures 56 in base 12. A one-quarter turn and pull of retainers 54 will maintain them in a withdrawn position. Top 14 is then raised to the open position assisted by gas shocks 38 which also maintain top 14 in the open position. Equipment, including lights 46, can now be removed from tray 18. Base 48 of each light 46 is plugged into a respective keyed receptacle 60, FIG. 1, in top 14. Other equipment, such as for example a computer keyboard (not shown) may be stored in tray 18 also. The keyboard and associated cords and connectors are all storable in tray 18. The keyboard is for use with an associated computer for programmed lighting control having a monitor 62 mounted on brackets 64 connected to console 10. Brackets 64 may also be stored in tray 18.

After set-up is complete, top 14 is moved to the closed position, assisted by shocks 38. When top 14 becomes nested with base 12, retainer members 54 are turned back one-quarter of a turn then released to automatically extend into apertures 56 in base 12 to retain top 14 and base 12 engaged in the closed position. Following a performance, the above-described set-up is dismantled, equipment is returned to tray 18 and console 10 can be hand-carried by hand gripping handle 20.

While this invention has been illustrated and described in accordance with a preferred embodiment, it is recognized that variations and changes may be made therein without departing from the invention as set forth in the claims.

Having described the invention, what is claimed is:

1. A console for controlling theater and stage lighting comprising:

a substantially rigid base;

a top including a control panel, She top being pivotally connected to the base and being pivotally movable relative to the base between a closed position, wherein the top and base are in nested contact, and an open position wherein the top is raised relative to the base;

the control panel including a plurality of movable control members mounted for hands-on operation on a first side of the top;

the top including control circuits connected for control changes responsive to the operation of the control members, the circuits being mounted on a second side of the top, opposite the first side, whereby the circuits can be accessed for maintenance when the top is in the open position;

an insulator member removably mounted on the second side of the top and substantially coextensive therewith for covering the circuits;

a storage compartment in the base, whereby when the top is in the open position, the storage compartment can be accessed;

the top including at least one elongated edge and elongated handle means which include and extend substantially along the entire length of said edge; and said elongated handle is generally hook-shaped in cross-section for ease of gripping.

2. A console for controlling theater and state lighting comprising:

a substantially rigid base;

a top including a control panel, the top being pivotally connected to the base and pivotally movable relative to the base between a closed position, wherein the top and base are in nested contact, and an open position, wherein the top is raised relative to the base:

the control panel including a plurality of moveable control members mounted for hands-on operation on a first side of the top;

the top including control circuits connected for control changes responsive to the operation of the control members, the circuits being mounted on a second side of the top, opposite the first side, whereby the circuits can be accessed for maintenance when the top is in the open position;

means interconnecting the base and top for maintaining the top in the open position;

a storage compartment in the base, whereby when the top is in the open position, the storage compartment can be accessed;

the top including at least one elongated edge;

handle means including and extending substantially along the entire length of said edge for hand gripping, whereby the console can be hand carried; and said elongated handle is generally hook-shaped in cross-section for ease of gripping.

3. A console for controlling theater and stage lighting comprising:

a substantially rigid base;

a top including a control panel, the top being pivotally connected to the base and pivotally movable relative to the base between a closed position, wherein the top and base are in nested contact, and an open position, wherein the top is raised relative to the base;

the control panel including a plurality of movable control members mounted for hands-on operation on a first side of the top;

the top including control circuits connected for control changes responsive to operation of the control members, the circuits being mounted on a second side of the top, opposite the first side, whereby the circuits can be accessed for maintenance when the top is in the open position;

means interconnecting the base and top for maintaining the top in the open position;

a storage compartment in the base whereby when the top is in the open position, the storage compartment can be accessed for removing or inserting items therein;

an insulator member removably mounted on the second side of the top and substantially coextensive therewith for covering the circuits, whereby when the top is in the closed position, the circuits are insulated from the storage compartment and items in the storage compartment are restrained from movement; and handle means on the top suitable for hand gripping, whereby the console can be hand carried, said top including at least one elongated edge, said handle means including and extending substantially along the entire length of said edge and having, in cross section, a hook shape.

4. The console as defined in claim 3 wherein the storage compartment is a compartmentalized tray.

5. The console as defined in claim 3, and further comprising:

light means detachably connected to the top and positionable for illuminating the control panel.

6. The console as defined in claim 3, and further comprising:

means for maintaining the top in the closed position.

7. The console as defined in claim 3 wherein said insulator member comprises a rigid foam board.

8. The console as defined in claim 7 wherein said insulator member further comprises a resilient compressible pad overlying said rigid foam board on the side thereof remote from said circuits.

9. The console as defined in claim 3 wherein the control members include bi-directionally rotatable control members, bi-directionally slidable control members, push-button control members and a track ball control member.

* * * * *